United States Patent [19]

Petersen et al.

[11] 3,967,094

[45] June 29, 1976

[54] ELECTRIC HEATING UNIT SUPPORT ASSEMBLY

[75] Inventors: Robert E. Petersen, Grafton; Robert J. Dietsche, Elyria, both of Ohio

[73] Assignee: Westinghouse Electric Corporation, Pittsburgh, Pa.

[22] Filed: Oct. 28, 1975

[21] Appl. No.: 626,413

[52] U.S. Cl. ..... 219/532; 174/148; 174/138 J; 248/68 R; 338/317

[51] Int. Cl.[2] ..... H05B 3/02

[58] Field of Search ..... 174/138 J, 148, 152 G, 174/153 G; 13/25; 219/355, 532, 536, 537, 542, 546, 548, 551; 338/290, 305, 317, 321; 248/68 R

[56] References Cited

UNITED STATES PATENTS

| | | | |
|---|---|---|---|
| 1,307,198 | 6/1919 | Harth | 338/290 UX |
| 1,493,386 | 5/1924 | Rice | 219/532 |
| 1,628,876 | 5/1927 | Ehrgott | 338/317 |
| 1,751,797 | 3/1930 | Dibble | 219/532 |
| 3,812,322 | 5/1974 | Osterkorn et al. | 219/532 |
| 3,920,887 | 11/1975 | Kloos et al. | 174/148 |

*Primary Examiner*—Laramie E. Askin
*Attorney, Agent, or Firm*—E. C. Arenz

[57] ABSTRACT

A pair of strips having spaced cutouts therein are placed in lapping relation so the cutouts form openings to receive insulating bushings having circumferential grooves therearound at least some of the end margins of the intervening webs between the cutouts being retroverted to take the form of barbs which in the assembled relation face corresponding barbs of the other strip.

4 Claims, 3 Drawing Figures

ELECTRIC HEATING UNIT SUPPORT ASSEMBLY

CROSS REFERENCE TO RELATED APPLICATION

Chesebro and Petersen U.S. patent application Ser. No. 626,412, filed Oct. 28, 1975 is a related application in that it also discloses a support member arrangement in which two strips are in interengaging relation.

BACKGROUND OF THE INVENTION

1. Field of the Invention

The invention pertains to the art of electric heating units and in particular to support means for carrying insulating bushings which support open-coil electrical resistance heating elements.

2. Description of the Prior Art

Prior art patents which teach support members for carrying insulating bushings and supporting open-coil elements for electric heating units of the same type with which this invention is concerned are the following: U.S. Pat. Nos. 3,812,322; 1,751,797 and 1,628,876. In the arrangement of the first two listed patents, after the strips with cutouts are placed in their final assembled position, an additional step is required to secure the two strips in their assembled relation. In the first noted patent the two pieces are not common in their construction. In the second listed patent the fastening arrangement is of the type which does not permit ready disassembly of the two strips for the replacement of an insulating bushing.

The present invention has among its aims the provision of an improved construction in which common pieces may be used for the two strips and in which intentional disengagement of the two strips may be accomplished relatively easily.

SUMMARY OF THE INVENTION

In accordance with the invention, the two strips of basically common shape and having spaced-apart cutouts include barbs formed by retroverting the end margins of at least some of the intervening webs between the cutouts and with the end edges of the barbs being in facing relation in the final assembly in which the strips are in lapped, opposed relation, the sides of the circumferential grooves of the insulating bushings holding the strips sufficiently close together that the barbs are prevented from becoming disengaged from each other.

DRAWING DESCRIPTION

DESCRIPTION OF THE PREFERRED EMBODIMENTS

Figure 1:
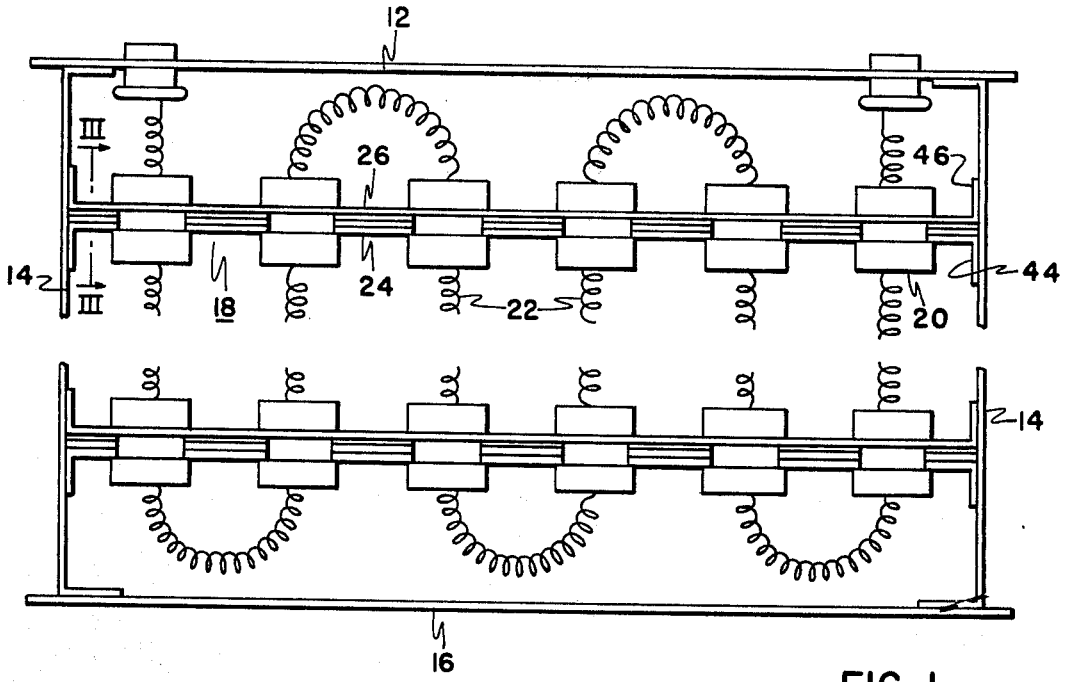
FIG. 1 is a plan view of a part of an electric heating unit according to the invention.

Referring to FIG. 1, the electric heating unit has the general form of an open-face perimetric frame formed of a base wall 12, side walls 14 and end wall 16. A plurality of support members generally designated 18 extend between the opposite side walls and carry ceramic insulating bushings 20 through which the open-coil electrical resistance heating element 22 is threaded.

Figure 2:
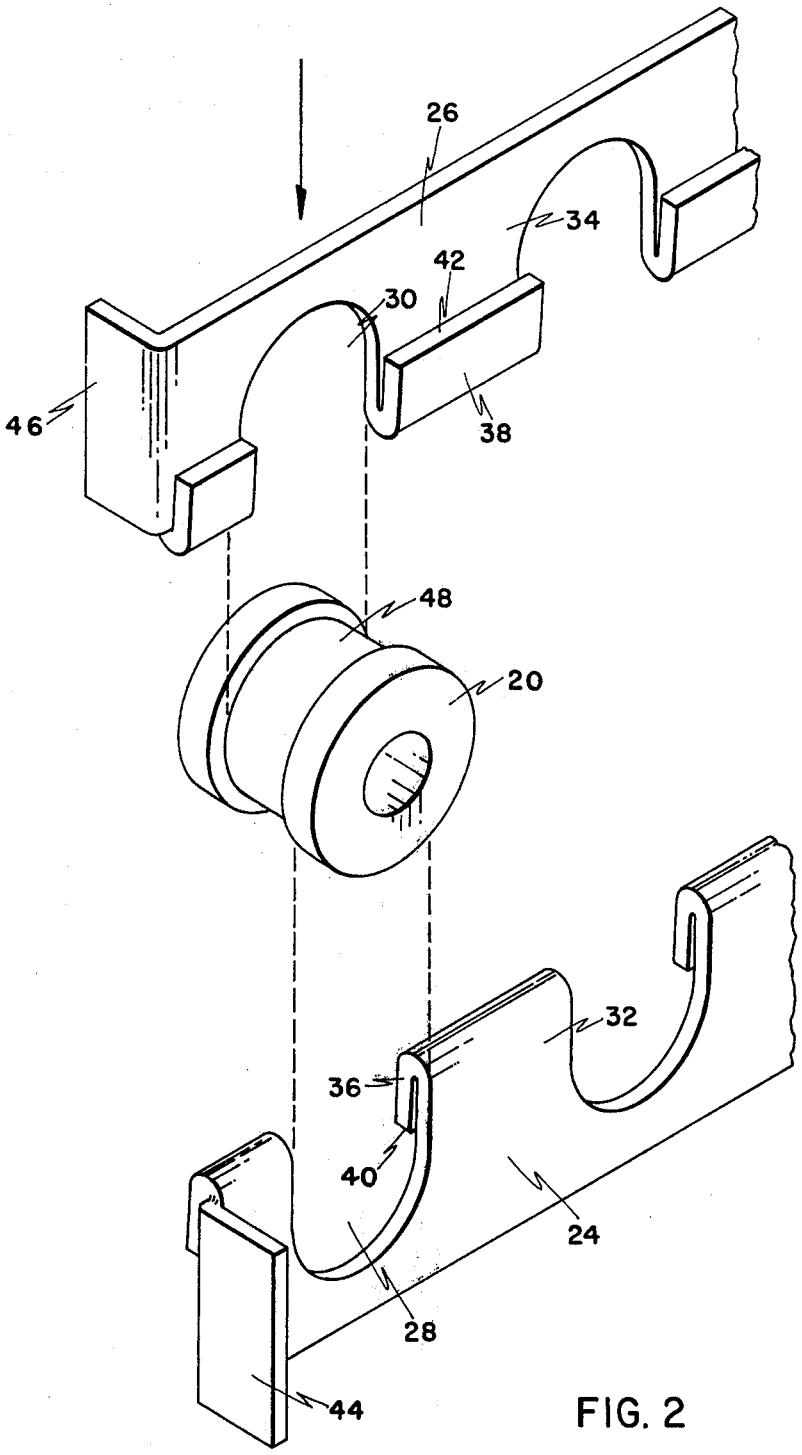
FIG. 2 is an exploded isometric view, greatly enlarged relative to FIG. 1, of a pair of strips and an insulating bushing prior to assembly.

The support members 18 for the bushings are of two-piece construction and may be best understood by reference to FIG. 2. The two metal strips 24 and 26 are of identical construction in the preferred form and include a series of spaced-apart, open-sided cutouts 28 and 30 for the respective strips, the cutouts being separated by the intervening webs 32 and 34 which have their end margins 36 and 38 bent back against the web to the retroverted positions shown in FIG. 2. The webs are made long enough so that after the retroversion, the end edges 40 and 42 will lie in a plane which, when the strips are assembled in lapping relation, will intersect the center of the openings formed by the cutouts of the two strips. That is, in the assembly the two strips are placed in opposed, lapping, registering relation so that a round opening is formed by the two opposing cutouts. In that assembled relation, the end edges of the end margins will be opposing or facing each other along a line passing through the centers of all the openings.

Each of the strips 24 and 26 may be provided with end flanges 44 and 46, respectively, if the parts are to be totally common, with the end flanges on one of the strips being used for fastening to the side walls of the heating unit by spot welding or the like. One suitable material for making the strips is 20 gauge sheet metal.

The ceramic insulating bushings 20 are each provided with a circumferential groove 48 which seats in the cutouts of one of the strips when the assembly is to be made. Then the other stip is moved into the noted lapping relation with the end margins passing each other until the end edges of the end margins have cleared each other.

Figure 3:
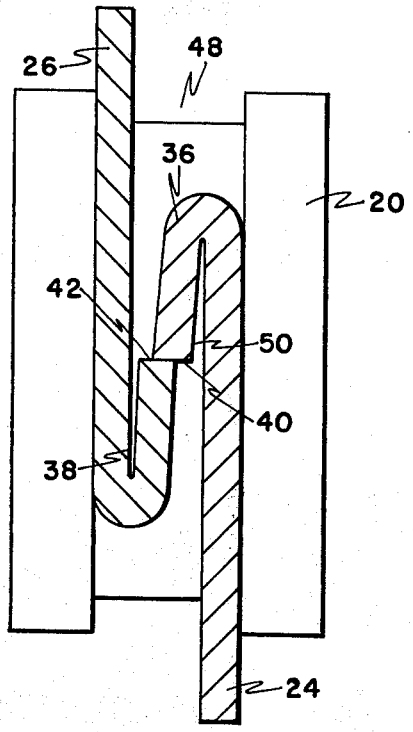
FIG. 3 is a sectional view, greatly enlarged, corresponding to one taken along the line III—III of FIG. 1.

Referring to FIG. 3, the relationship of the strips 24 and 26 and their elements to each other and the insulating bushing is made apparent by the enlarged view. The groove 48 has a width approximating the sum of four single thicknesses of the strip material so that strips can be assembled in the lapping relation with the end margins 36 and 38 passing each other during the assembly process. To the end that after the strips have been assembled with the bushing the strips do not disengage from each other, the retroversion of the end margins to form barb-like elements is slightly less than a complete 180° retroversion. In other words, a small acute angle is left between the end margins and web as at 50 so that after the end margins have passed each other in the assembly and the end edges clear, the end margins will flex back slightly to the positions shown in FIG. 3. Thus even though the strips can shift laterally with respect to each other and the bushing, the abutment of the end edges to each other is not totally lost, and accidental disengagement of the two strips from each other is prevented. However, if it should be desired to disengage the strips from each other, for the purpose of replacing a broken insulating bushing for example, the barb members may be flexed back toward the web so that the end edges will clear to permit the disengagement of the strips from each other.

The arrangement permits the assembly of the parts to make up the electric heating unit as follows. The strips 24 which have upwardly open cutouts are fastened at their ends to the side walls 14. The coil 22 having the required number of bushings 20 strung thereon is then placed in position with one bushing 20 seated in each cutout. The strips 26 are then pushed down in place in the grooves of the insulators until the barb ends clear each other and assume the FIG. 3 position. Thus the assembly is accomplished without the use of any tools or any requirement of fastening the one set of strips 26.

We claim:

1. A support member carrying insulating bushings for supporting an open coil electrical heating element, comprising:

a pair of strips, each having a number of spaced-apart, open-side cutouts with intervening webs having retroverted end margins, placed in opposed, lapping and registering relation with the cutouts forming openings for the insulating bushings and the end edges of said margins facing each other;

an insulating bushing in each said opening, said bushing including a circumferential groove of a width approximating the sum of four single thicknesses of said strips so that the assembly of the strips in the lapping relation can be effected with said bushings seated in place in the cutouts of one of said strips, the lateral restraint effected by the sides of the grooves holding the strips in a position that the end edges are maintained in an interfering relation preventing disengagement of the strips from their lapping relation.

2. A support member according to claim 1 wherein:

the retroversion of said end margins is less than 180° so that a relatively small acute angle exists between said end margins and said web.

3. An electric heating unit comprising:

an open-face perimetric frame;

a number of spaced-apart support members extending across said frame, each support member including a pair of strips each having a plurality of open-ended cutouts spaced apart by intervening webs, the cutouts facing in opposite directions, the webs of both strips having retroverted end margins, the strips being disposed in lapped relation so that the cutouts form openings in the support member to receive insulating bushings, the end edges of the respectively opposite end margins being in facing relation;

an insulating bushing located in each said opening of the support members, each said bushing having a circumferential groove of a width to accommodate the passage of the double thickness end margins past each other in relatively tight relation during assembly so that said strips can be assembled in said lapped relation, with the end edges of the end margins being retained in interfering relationship by the limited width of the groove to thereby prevent disengagement of the two strips from each other; and an electrical resistance heating element threaded through and supported by said bushings.

4. A unit according to claim 3 wherein:

the retroversion of said end margins is sufficiently less than 180° so that a relatively small acute angle exists between said retroverted end margins and said web.

* * * * *